US009764801B2

(12) United States Patent
Syvertsen et al.

(10) Patent No.: US 9,764,801 B2
(45) Date of Patent: Sep. 19, 2017

(54) CARGO TRANSFER VESSEL

(71) Applicant: Cefront Technology AS, Arendal (NO)

(72) Inventors: Kare Syvertsen, Arendal (NO); Arne Smedal, Faervik (NO)

(73) Assignee: Cefront Technology AS, Arendal (NO)

( * ) Notice: Subject to any disclaimer, the term of this patent is extended or adjusted under 35 U.S.C. 154(b) by 0 days.

(21) Appl. No.: 14/898,751

(22) PCT Filed: Jun. 23, 2014

(86) PCT No.: PCT/EP2014/063141

§ 371 (c)(1),
(2) Date: Dec. 16, 2015

(87) PCT Pub. No.: WO2014/206927

PCT Pub. Date: Dec. 31, 2014

(65) Prior Publication Data

US 2016/0137273 A1 May 19, 2016

(30) Foreign Application Priority Data

Jun. 26, 2013 (NO) ..... 20130887

(51) Int. Cl.
*B63B 35/66* (2006.01)
*B63B 27/25* (2006.01)
(Continued)

(52) U.S. Cl.
CPC ..... *B63B 27/25* (2013.01); *B63B 1/32* (2013.01); *B63B 27/34* (2013.01); *B63B 35/66* (2013.01);
(Continued)

(58) Field of Classification Search
CPC ..... B63B 22/021
See application file for complete search history.

(56) References Cited

U.S. PATENT DOCUMENTS 1,599,311 A * 9/1926 Zu Lynar Passy-De Chimang ..... B63B 1/04 114/61.32
5,803,779 A 9/1998 Horton
(Continued)

FOREIGN PATENT DOCUMENTS

| | | |
|---|---|---|
| FR | 2857347 A | 1/2005 |
| JP | 2007238007 | 9/2007 |
| WO | WO 98/30439 | 7/1998 |

*Primary Examiner* — Edwin Swinehart
(74) *Attorney, Agent, or Firm* — Christian D. Abel

(57) ABSTRACT

The invention concerns a cargo transfer vessel (3) for transferring fluid between an offshore production facility and a tanker and a method for transferring the fluid. The cargo transfer vessel comprise a hull (20) having a first and a second outer longitudinal hull side; a deck (30), propulsion means for actively maintaining the cargo transfer vessel at a predetermined distance from the offshore production facility and the tanker during fluid transfer operations and fluid transfer means for transferring fluid between the offshore structure and the tanker. The vessel is further characterized in that the hull comprises a main hull member and at least one protruding hull member (13) arranged below the cargo transfer vessels water line at each of the outer longitudinal hull sides for suppressing roll of the vessel, wherein the at least one protruding hull member extends at least partly along the hulls longitudinal length, i.e. from the start of the vessel's bow to the end of the vessel's aft.

14 Claims, 18 Drawing Sheets

(51) Int. Cl.

| | |
|---|---|
| ***B63B 27/34*** | (2006.01) |
| ***B63B 1/32*** | (2006.01) |
| *B63B 35/44* | (2006.01) |
| *B63B 39/06* | (2006.01) |

(52) U.S. Cl.
CPC ... *B63B 2035/448* (2013.01); *B63B 2039/067* (2013.01)

(56) References Cited

U.S. PATENT DOCUMENTS

| | | | | |
|---|---|---|---|---|
| 7,793,605 | B2 * | 9/2010 | Poldervaart ..... | B63B 21/04<br>114/230.15 |
| 2005/0016431 | A1 | 1/2005 | Oma et al. | |
| 2011/0061578 | A1 | 3/2011 | Lee et al. | |
| 2011/0126750 | A1 | 6/2011 | Leverette | |

* cited by examiner

CARGO TRANSFER VESSEL

TECHNICAL FIELD

The invention concerns a method and a system for transferring hydrocarbon fluid from an offshore production facility to a fluid carrying vessel.

BACKGROUND AND PRIOR ART

Loading of fluid to tankers in open sea may be a demanding operation, in particular in harsh environment. The operation requires dedicated shuttle tankers equipped with dynamic positioning system, excessive thruster capacity and specialized loading systems. Such shuttle tankers are equipped with loading systems, normally installed in the vessel's bow, enabling the tanker to connect to a floating production facility, a loading tower or loading buoy via a loading hose, and thereby allowing transfer of the cargo to the tanker. The tanker can be moored to the production by a flexible hawser, assisted by vessel's own thrusters or propellers. The tanker can alternatively be positioned by its own thruster system (Dynamic Positioning System) without any mooring hawser.

The most advanced system for loading tankers is the proven Submerged Turret Loading, STL, where the tankers is connected to the transfer line of cargo through the vessel's bottom by a rotating buoy moored to sea bed, as e.g. disclosed in WO 95/08469. The STL system allow operation all year round in the most exposed and harsh environment such as the North Sea and North Atlantic regions. Typically for these systems are dedicated ships with additional special designed equipment, resulting in higher investment compared with conventional tankers.

In more benign areas, offshore loading with conventional tankers can be performed using moored floating buoys (Catenary Anchor Leg Moorings, CALM Buoys) moored to the seabed. See e.g. WO 2012/035354. Loading of tankers with CALM buoys are limited by the sea state, current and wind.

The main challenge using conventional tankers are their limited maneuvering and station keeping capabilities. Lately the Hiload concept was introduced to the market. See e.g. WO 2005/118389 A1. The Hiload is a self-contained semi submerged construction with propellers and thrusters. The unit is capable of attaching to the tanker's hull, thereby assisting the tanker's maneuverability. The Hiload requires a dedicated support vessel to assist the Hiload in idle periods and a specialized crew when in operation.

A system that addresses the above disadvantages is disclosed in U.S. Pat. No. 5,803,779. A loading buoy in the form of a floating hull is provided with hawser lines, propulsion means and liquid transfer means to ensure safe liquid transfer operations at a predetermined distance from the offshore structure. However, the disclosed system is considered vulnerable to environmental induced movements such as roll, in particular during liquid transfer. In addition, the suitability for use as an effective means of transport is questionable.

There is therefore a need to mitigate the disadvantages with the existing systems and to further reduce the investments in extra equipment.

It is thus an object of the present invention to provide a method and a system that further improves the loading efficiency of conventional tankers, LNG carriers or other ships carrying fluids in open sea.

SUMMARY OF THE INVENTION

The present invention is set forth and characterized in the main claims, while the dependent claims describe other characteristics of the invention.

More specifically, the invention concerns a cargo transfer vessel for transferring fluid between an offshore production facility and a tanker. The cargo transfer vessel comprise a hull having a first and a second outer longitudinal hull side; a deck, propulsion means for actively maintaining the cargo transfer vessel at a predetermined distance from the offshore production facility and the tanker during fluid transfer operations and fluid transfer means for transferring fluid between the offshore structure and the tanker. The vessel is further characterized in that the hull comprises a main hull member and at least one protruding hull member arranged below the cargo transfer vessels water line at each of the outer longitudinal hull sides for suppressing roll of the vessel, wherein the at least one protruding hull member extends at least partly along the hulls longitudinal length, i.e. from the start of the vessel's bow to the end of the vessel's stern. The protruding hull member preferably extends between 10% and 90% of the longitudinal length, more preferably between 20% and 80% of the longitudinal length, even more preferably between 30% and 70% of the longitudinal length, even more preferably between 40% and 60% of the longitudinal length, for example about 50%.

In an advantageous embodiment the extension of the at least one protruding hull member includes the hulls longitudinal midpoint.

In another advantageous embodiment at least one longitudinal section of the at least one protruding hull member extends beyond the lateral boundaries of the cargo transfer vessel's deck, i.e. beyond the outer edge of the deck situated parallel to the water after submersion. In an alternative formulation at least one longitudinal section of the at least one protruding hull member extends beyond a vertical projection of the portion of the vessel situated above the water line.

In another advantageous embodiment the outermost horizontal projection of one or both end sections of at least one of the at least one protruding hull member defines a resistance reducing arc curving towards the hull's vertical center plane, thus reducing the vessel's propulsion resistance. The ends of the protrusion are defined as the ends situated at the most forward and the most rearward part of the protrusion. Furthermore, an end section may be defined as an entire longitudinal half of a protrusion. However, in a more preferred definition the end section is defined as covering only a part of each longitudinal half, such as 40% of the longitudinal half measured from the outer longitudinal end. Other examples of end section lengths may be 30%, 20%, 10% or 5%.

In another advantageous embodiment the outermost horizontal projection of both end sections of at least one of the at least one protruding hull member defines a resistance reducing arc curving towards the hull's vertical center plane, wherein the length of the resistance reducing arc at one end section is shorter than the length of the resistance reducing arc at the opposite end section. The resistance reducing arc with the shorter length may be situated closest to the bow of the cargo transfer vessel.

In another advantageous embodiment at least one of the resistance reducing arc(s) terminates at a termination point situated at the surface of the main hull member.

In another advantageous embodiment the inclination angle of at least part of the at least one protruding hull member, relative to the horizontal plane, is between 0° and 10°. The at least part of the at least one protruding hull member may for example be the part situated between of the protrusion ends. Furthermore, one or both of the protrusion ends may have an inclination angle exceeding 10° relative to the horizontal plane. The horizontal plane is defined as the plane oriented parallel to the water surface after vessel submersion.

In another advantageous embodiment the main part of the cargo transfer vessel's bottom is flat.

In another advantageous embodiment the fluid transfer means comprises a loading arrangement, preferably situated at the bow part of the vessel, for receiving fluid from the offshore structure comprising a loading manifold configured to be connected to an end of at least one production facility loading hose, a discharge arrangement, preferably situated at the stern part or midship part of the vessel, for discharging fluid to the tanker, comprising at least one vessel discharge hose and a fluid coupling system situated in the cargo transfer vessel forming a fluid communicating coupling between the loading arrangement and the discharge arrangement.

The invention also concerns a method for transferring hydrocarbon containing fluid from an offshore production facility to a tanker via a cargo transfer vessel. The vessel comprises a floating hull having a first and a second outer longitudinal side, a deck, a loading arrangement for receiving fluid from the offshore structure including a loading manifold, a discharge arrangement for transferring fluid to the tanker including at least one vessel discharge hose, and a fluid coupling system situated in the cargo transfer vessel forming a fluid communicating coupling between the loading arrangement and the discharge arrangement.

The method comprises the following steps:

a. transferring an end of the vessel discharge hose from the cargo transfer vessel to the tanker manifold,
b. connecting the end of the vessel discharge hose to the tanker manifold, allowing the fluid to flow from the cargo transfer vessel to a fluid tank within the tanker,
c. moving the cargo transfer vessel to a position where at least one production facility loading hose may be transferred between the offshore production facility and the cargo transfer vessel, for example by means of a production facility messenger line,
d. connecting the at least one production facility loading hose to the loading arrangement and
e. transferring desired amount of fluid between the offshore production facility and the tanker via the at least one production facility loading hose, the loading arrangement, the fluid coupling system and the discharge arrangement.

The floating hull may advantageously display at least one roll suppressing protrusion arranged below the cargo transfer vessels water line. Further, the production facility loading hose may be situated on the offshore production facility, on the cargo transfer vessel or a combination of both.

In an advantageous embodiment the method comprises the additional step of connecting at least one tanker hawser between the cargo transfer vessel and a first end of the tanker prior to step a.

In another advantageous embodiment step a comprises the additional steps of transferring the end of the at least one vessel discharge hose to an assisting tug and moving the assisting tug with the end of the vessel discharge hose to a position where the end of the vessel discharge hose may be connected to the tanker manifold.

In another advantageous embodiment step a comprises the additional step of picking up and pulling at least one messenger line connected to the end of the at least one vessel discharge hose in order to facilitate the hose transfer.

In another advantageous embodiment the method comprises the additional step of moving an assisting tug to a second end of the tanker, connecting a tug towing hawser between the assisting tug and the second end of the tanker and adding a pulling force on the second end of the tanker by means of the assisting tug, the pulling force being directed away from the offshore production facility.

In another advantageous embodiment the method comprises the additional step of connecting at least one production facility hawser between the offshore production facility and the cargo transfer vessel after step c.

The hawser may for example be stored on the production facility.

In another advantageous embodiment the method comprises the additional step of controlling the position of the cargo transfer vessel by means of dynamic positioning means.

In another advantageous embodiment the method comprises the additional step of controlling the flow rate between the offshore production facility and the tanker by means of at least one booster pump during step e.

In another advantageous embodiment the cargo transfer vessel is in accordance with any one of features mentioned previously.

The invention also concerns a transfer arrangement for transferring hydrocarbon containing fluid from an offshore production facility to a tanker. The transfer arrangement comprises an offshore production facility for producing hydrocarbons, a tanker for receiving and storing hydrocarbons and a transfer vessel in accordance with any of the features mentioned previously. The transfer arrangement may advantageously also comprise an assisting tug suitable for transferring an end of at least one vessel discharge hose from the cargo transfer vessel to the tanker manifold on the tanker and/or suitable for adding a pulling force on the second end of the tanker, the pulling force being directed away from the offshore production facility, and at least one production facility loading hose suitable for connection between the offshore production facility and the cargo transfer vessel.

Normally a conventional tanker is requiring assistance from tugs and transfer vessels. As apparent from the above description and the claims, the invention offers a solution in which the transfer vessels include equipment allowing a tanker to approach and unload a floating production unit or terminal. Preferably the transfer vessel should be equipped with a dynamic positioning system (DP) allowing the transfer vessel to keep the position relative to the floating production terminal while the tanker weathervanes from the stern of the transfer vessel.

In the following description, numerous specific details are introduced to provide a thorough understanding of embodiments of the claimed vessel and method. One skilled in the relevant art, however, will recognize that these embodiments can be practiced without one or more of the specific details, or with other components, systems, etc. In other instances, well-known structures or operations are not shown, or are not described in detail, to avoid obscuring aspects of the disclosed embodiments.

BRIEF DESCRIPTION OF THE DRAWINGS

Preferred embodiments of the present invention will now be described with reference to the attached drawings, in which:

FIG. 8B shows the spooling device of the offloading system in two different spooling positions relative to an offloading hose drum, FIG. 9B shows arrangements with a vessel discharge hose reeled onto, and unreeled from, the offloading hose drum, respectively.

DETAILED DESCRIPTION OF THE INVENTION

Figure 1:
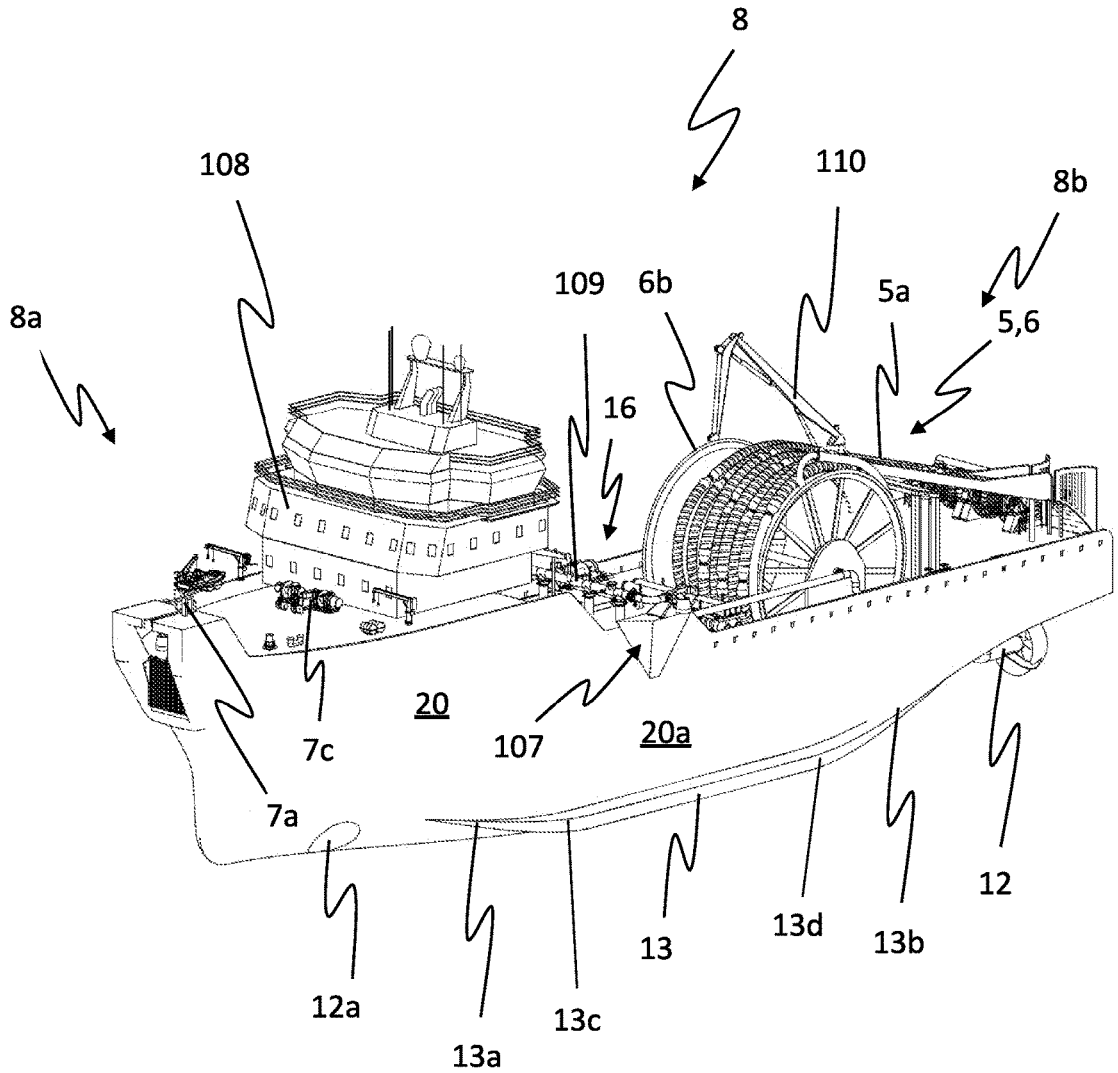
FIG. 1 shows a perspective view of a cargo transfer vessel with a bow part in accordance with a first embodiment of the invention.
Figure 2:
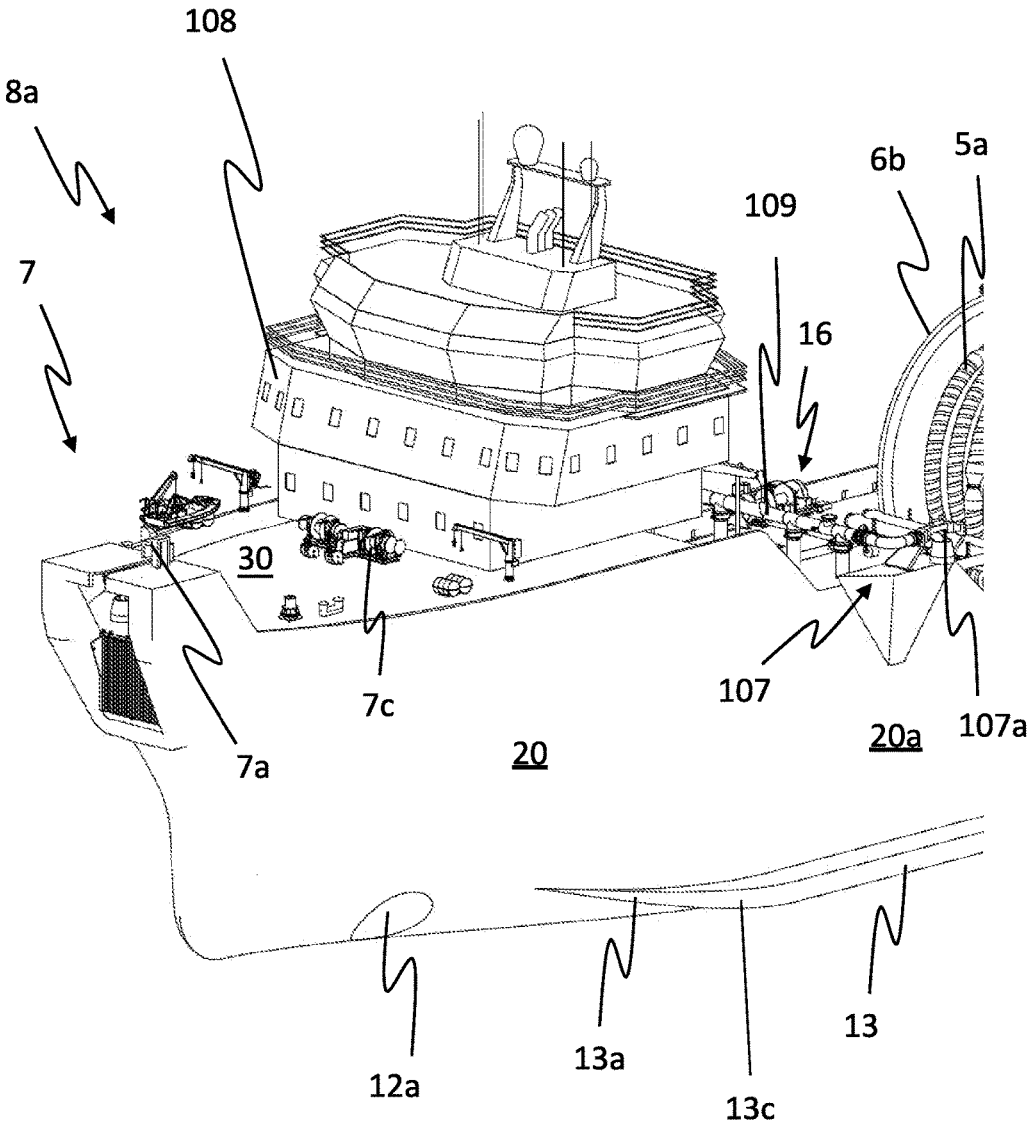
FIG. 2 shows a perspective view of the bow part of the cargo transfer vessel in FIG. 1.

FIGS. 1 and 2 shows a cargo transfer vessel 8 in accordance with the invention, hereinafter referred to as a CTV, for assisting the offloading and transfer of fluid from an offshore production facility 1 to a fluid carrying vessel 2 (shown in FIGS. 12-18). Examples of offshore production facilities 1 may be a floating production storage and offloading unit (FPSO), a floating storage and offloading unit (FSO) or a floating liquefied natural gas unit (FLNG). Examples of fluid carrying vessels 2 may be a conventional tanker or a LNG carrier. As best illustrated in FIG. 2 the bow part 8*a* of the CTV 8 is equipped with a loading arrangement 7 having a loading manifold 7*a* configured to connect an end of a production facility loading hose 10 (such as a standard dry break loading hose end piece) into fluid communication with an onboard fluid coupling system 16. The loading arrangement 7 also includes a loading crane (not shown) to inter alia facilitate said connection. The loading manifold 7*a* may have a quick disconnect function. Other equipment of the loading arrangement 7 may be a combined line-handling winch 7*c* suited for pull-in and connection of loading hoses 10, a back-up connection for direct connect of a back-up loading hose (i.e. a fixed flange with an integrated double valve for safe disconnection without oil-spill), sheaves etc. for pull-in of the back-up loading hose, valves and cargo pipes 109 for safe operation and transfer of oil, service cranes located adjacent of the bow part 8*a* for equipment handling and service, and anchor winches with chain lockers.

One or more optional second loading arrangements 107 may be positioned at the side(s) of the CTV 8, preferably aft of the CTV's living quarter 108, as illustrated in FIGS. 1 and 2. If the roll motion of the CTV 8 is sufficiently small (see below), loading of fluid at the side of the CTV 8 represents a robust and safe loading method for a floating loading hose 10. It may also be a catenary type loading hose 10 used as an alternative, or an addition, to the bow loading arrangement 7.

Figure 3:
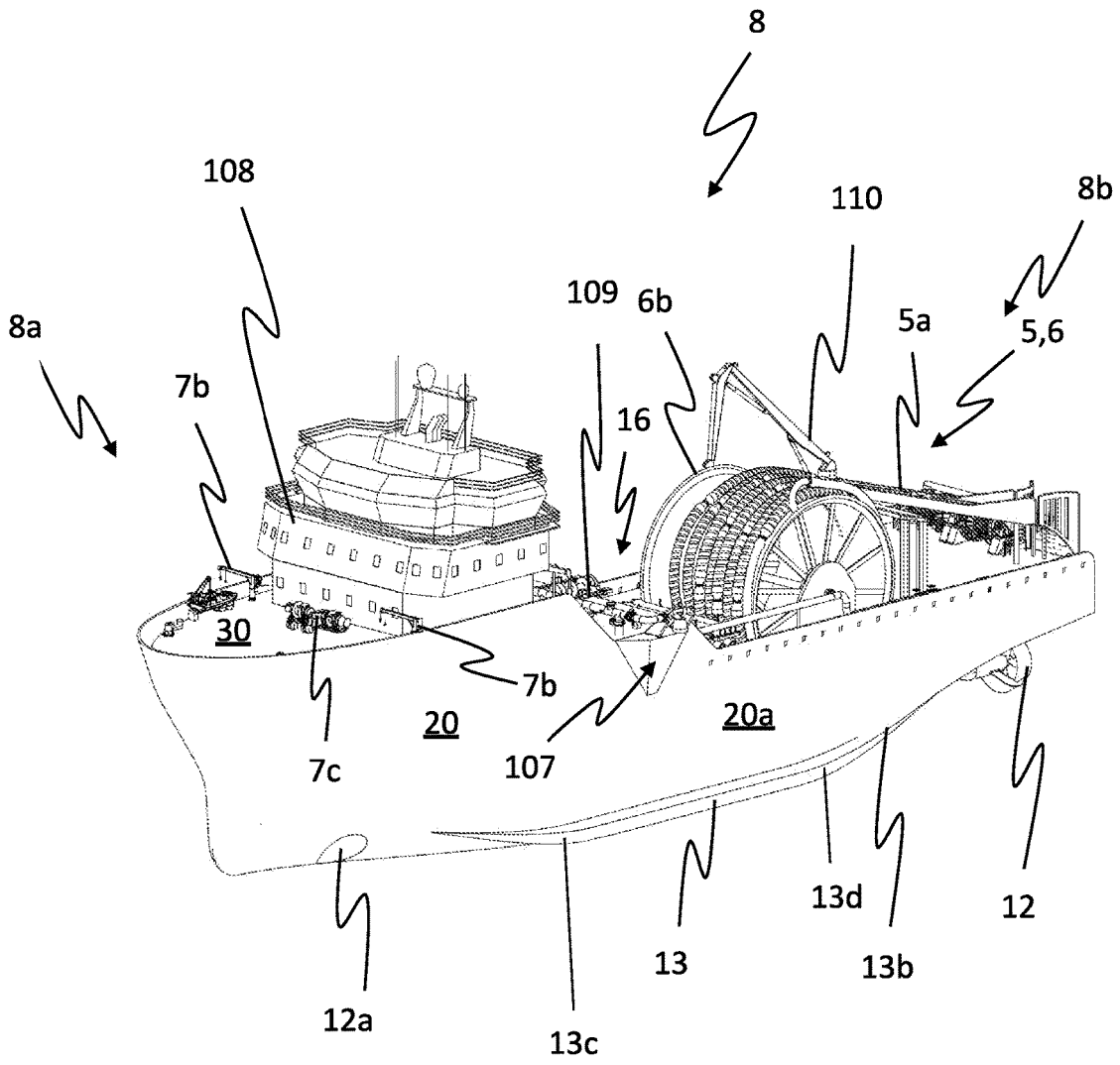
FIG. 3 shows a perspective view of a cargo transfer vessel with a bow part in accordance with a second embodiment of the invention.
Figure 4:
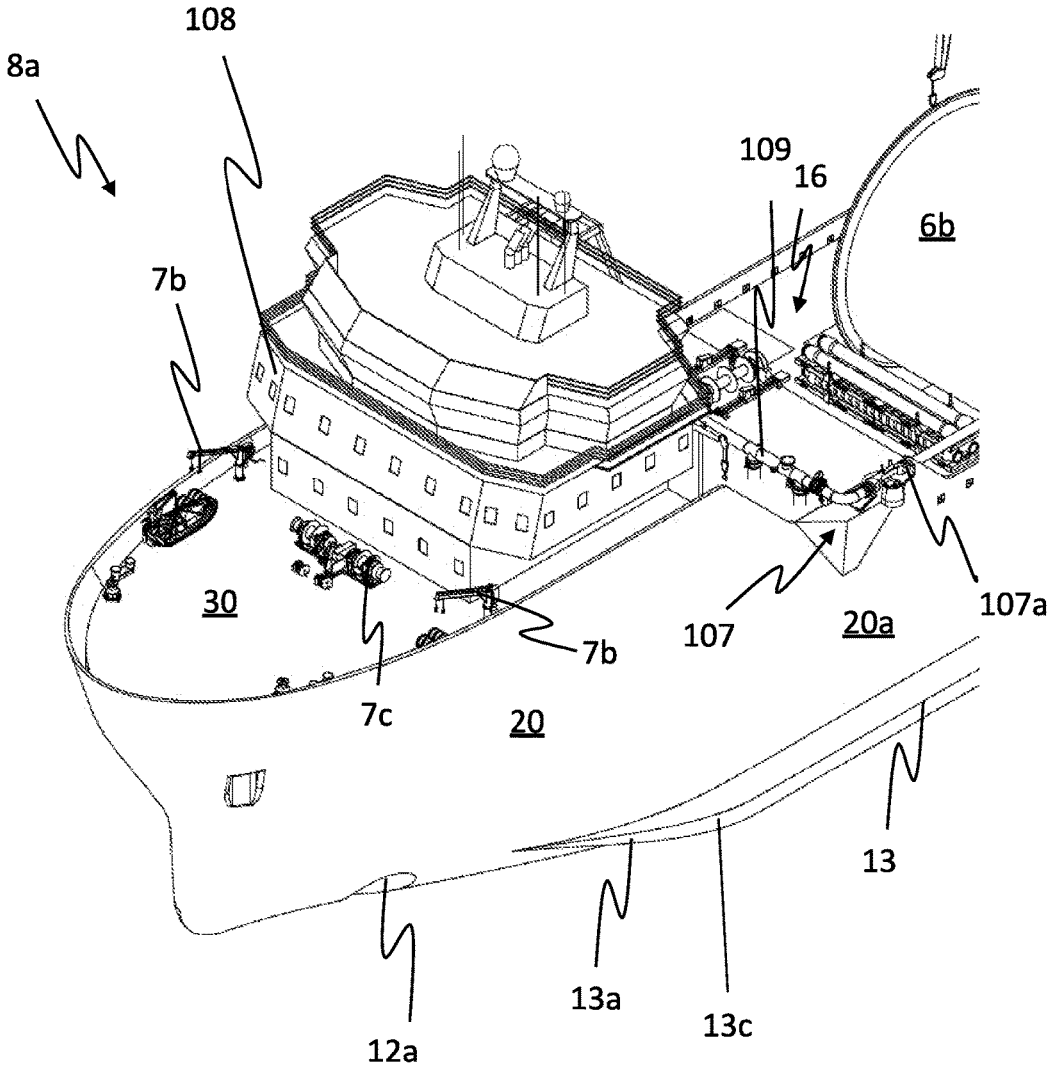
FIGS. 4 and 5 show perspective views from two different angles of the bow part of the cargo transfer vessel in FIG. 3, FIGS. 6A and 6B show side views of a cargo transfer vessel in accordance with the invention, viewed perpendicular and parallel to the vessels longitudinal axis, respectively.
Figure 5:
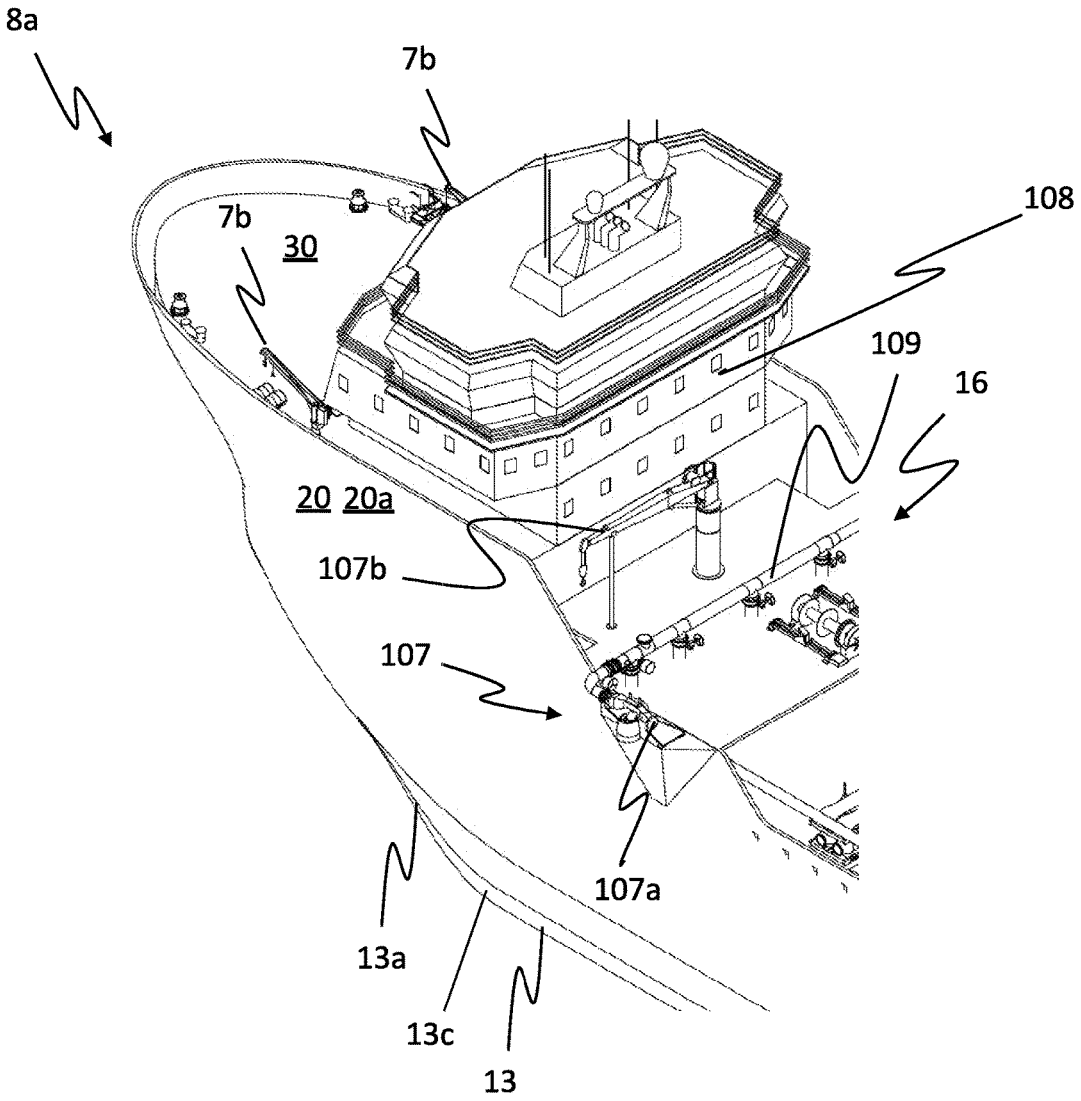

FIGS. 3-5 show a CTV 8 which is similar in design and function as the CTV 8 disclosed with reference to FIGS. 1 and 2. However, in contrast to the previously disclosed CTV 8 the loading manifold(s) 107*a* of the side loading arrangement 107 is/are located solely at the side(s) of the CTV 8, i.e. not at the bow part 8*a*, thereby providing a less complex and less expensive solution. As for the first embodiment the side loading arrangement 107 may also include a dedicated service crane 107*b*.

In the above figures a protrusion 13 is seen extending along part of the CTV's 8 longitudinal length at each side 20*a*, 20*b* of the hull 20. The principal purpose of these protrusions 13 is to suppress roll of the CTV 8 due to environmental forces (waves, wind, current, etc). Extensive tests have shown that these protrusions 13 are effectively suppressing rolling motions down to levels considered acceptable in order to perform fluid transfer at wind sea exposure of at least 5 meters significant wave height, even during side loading to the CTV 8.

The outermost horizontal projection of both ends of the protrusion defines a resistance reducing arc 13*c*, 13*d* curving towards the hull's vertical center plane, where the length of the resistance reducing arc 13*c* at the first end section situated closest to the bow is shorter than the length of the resistance reducing arc 13*d* at the opposite second end section.

Figure 6:
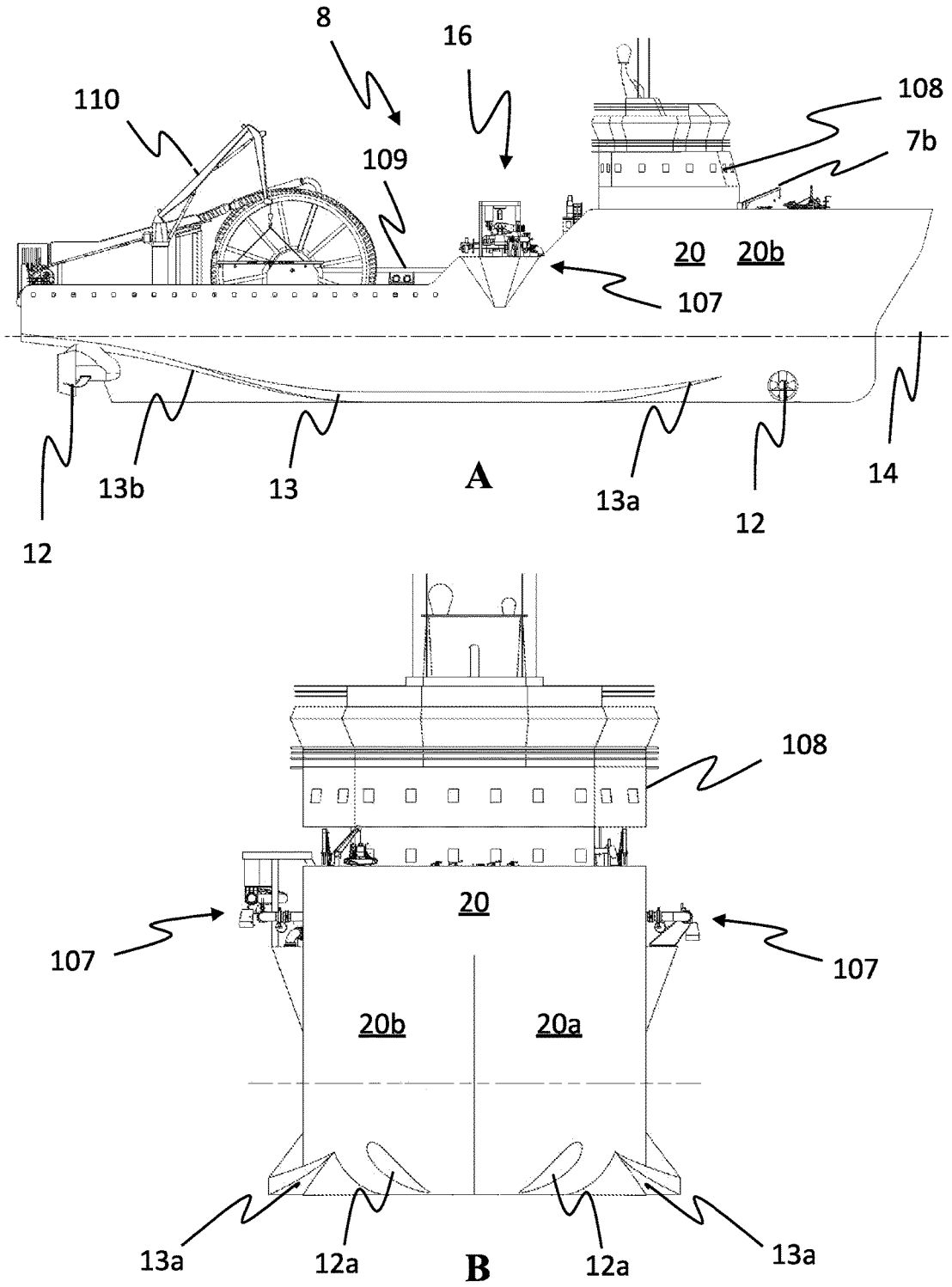

These protrusions are better illustrated in FIG. 6, presenting two side views of the CTV 8;

- perpendicular to the CTV's longitudinal axis (FIG. 6A) and
- along the longitudinal axis, as viewed from the bow side (FIG. 6B).

Figure 7:
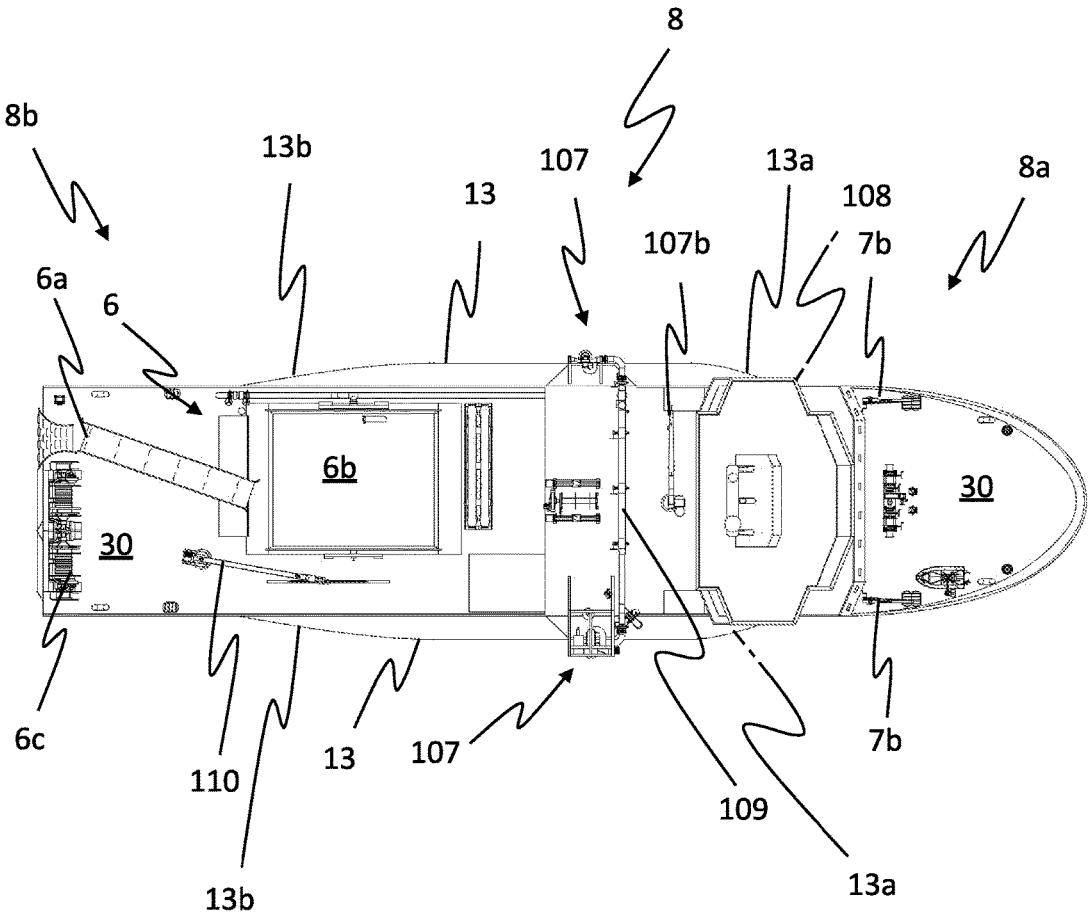
FIG. 7 shows a top view of a cargo transfer vessel with a reel-based offloading system in accordance with a first embodiment of the invention.

The side loading arrangement(s) 107 is/are identical to the side loading arrangements 107 shown in FIGS. 3-5. FIG. 6A shows an example where the entire length of the protrusion 13 is situated below the water line 14, and extends from at least near the CTV's bow part 8*a* (approximately at the bow side end of the living quarter 108) to the CTV's stern part 8*b*. Moreover, the protrusion 13 curves in direction towards the water line 14 at both the bow end section 13*a* and the stern end section 13*b* in order to minimize the propulsion resistance during forward thrust. In particular, FIG. 6*a* shows an example where the mid part of the protrusion 13 follows at, or near, the base of the illustrated flat-bottom hull (FIG. 6B). Further, the stern end section 13*b* curves fully up to the water line 14, above the vessels main thrusters 12, and the bow end section 13*a* curves partly up to the water line 14, aft of a bow-part situated DP thruster 12*a*. The particular bending radii in respect of the mid, non-bending part of the protrusion 13 and in respect of the water line 14, may be set based on computer simulations and/or model experiments. The protrusion 13 shown in FIGS. 6A and 6B is mirrored on both sides of the vessel's 8 outer longitudinal hull sides 20*a*,20*b*. The mirroring of the protrusions 13 on both hull sides 20*a*,20*b* is most apparent in FIG. 7 where the entire CTV 8 is shown in top view. FIG. 7 also clearly shows the side loading arrangement 107 situated at both sides of the CTV 8 and the reel-based offloading system 6 situated at the stern part 8*b*.

Figure 8:
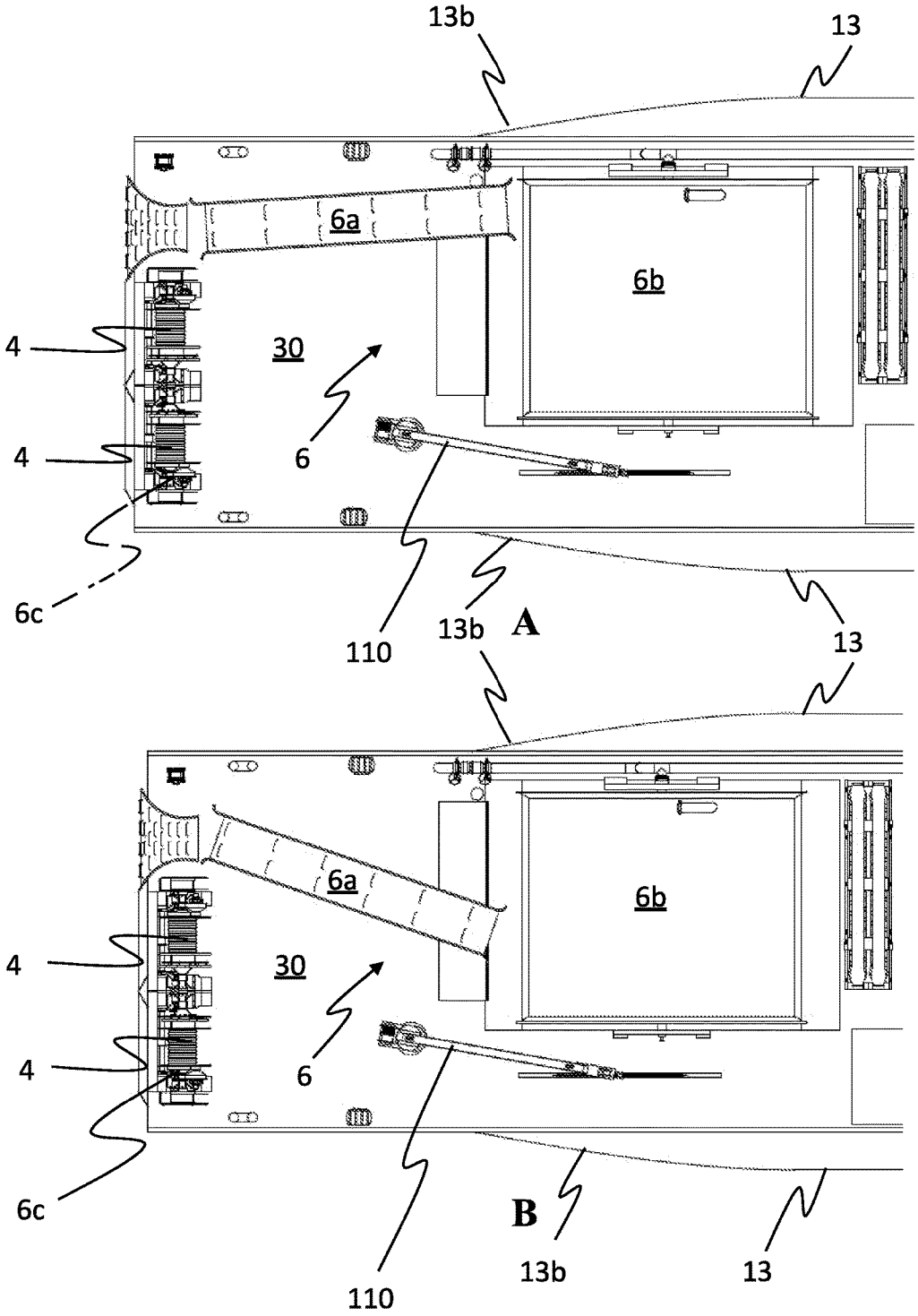
FIG. 8 shows top views of the stern part of a reel-based offloading system in accordance a first embodiment of the invention, in which FIG. 8A

The discharge arrangement 5 shown in FIGS. 8A and 8B for discharge of fluid from the CTV 8 to the tanker 2 is preferably similar to the standard arrangement used for loading from floating production and storage units 1 to shuttle tankers or conventional tankers. The equipment on board the CTV 8 is in FIG. 8 shown as a standard Stern Discharge System (SDS) 5 which includes a reel-based offloading system 6 having inter alia a spooling device 6*a*, an discharge hose drum 6*b* and a mooring hawser arrangement 6*c*. The hose drum 6*b* may be lowered into a recess 20*c* of the hull 20 to ensure efficient operation and maintenance. Draining of the recess 20*c* may be made directly to a slop tank (not shown). Access to the lower section of the drum 6*b* is preferably achieved from a position down in the recess 20*c*. Further, the mooring hawser arrangement 6*c* may be placed aft on the main deck 30 and include a plurality of tanker hawsers 4. The spooling device 6*a* is in FIG. 8 illustrated as an inclined (see FIG. 10) loading hose support structure (chute), which longitudinal end situated closest to the drum 6*b* may be shifted along the drum's axial extension, thereby ensuring even spooling. The spooling device 6*a* presented in FIG. 6 achieves the axial shifting of its end by controlled pivoting around the opposite end.

FIG. 9A and 9B shows the vessel discharge hose 5*a* in an at least partly reeled and a fully unreeled state, respectively. In the reeled state, the pivotable spooling device 6*a*, which is configured to cover the full axial distance of the drum 6*b*, is in FIG. 9A seen arranged with its end in an axial mid position relative to the drum 6*b*. In the unreeled state the spooling device 6*a* is arranged with its end in a leftmost axial position relative to the drum 6*b*. The discharge hose 5*a* may comprise a main section and one or more second sections, in which the main section is a large diameter hose string made up of interconnected hose segments and the second section(s) are made of smaller diameter hose segments which are tailored for connection to a midship manifold 3 of the tanker 2. The second section(s) and the main section would in this embodiment be connected by transition piece(s).

In addition to tanker hawsers 4, the mooring hawser arrangement 6*c* may comprise a chafing chain, a thimble and a messenger line. The tanker hawser 4 may be a super-line or double braid nylon hawser with soft eyes in both ends.

Figure 10:
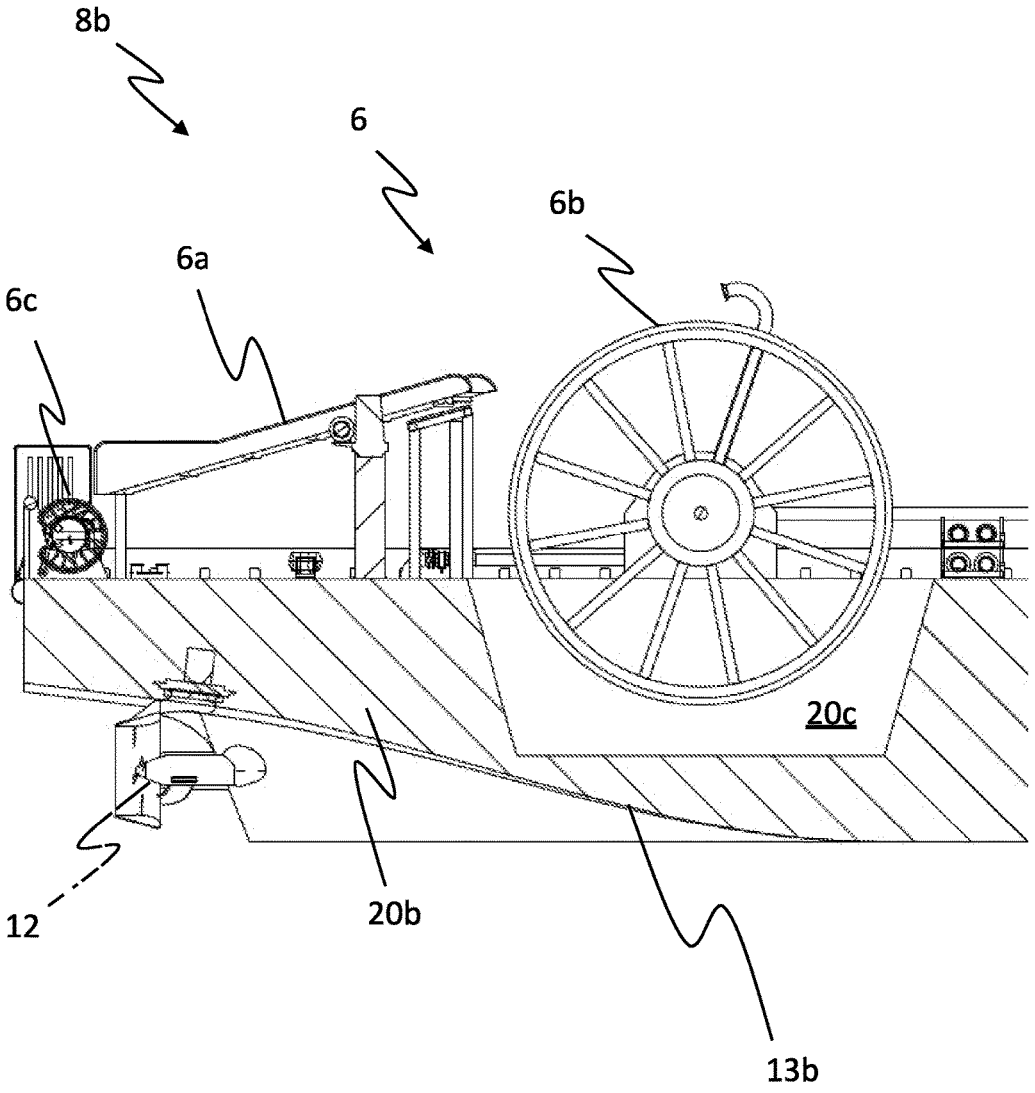
FIG. 10 shows a side view of the stern part of a cargo transfer vessel with a reel-based offloading system in accordance with the first embodiment of the invention.

FIG. 10 shows a cross section side view along the stern part 8*a* of the CTV 8, illustrating offloading system 6 and the main thruster 12. The recess 20*c* surrounding the lowered hose drum 6*b* is clearly seen.

Figure 9:
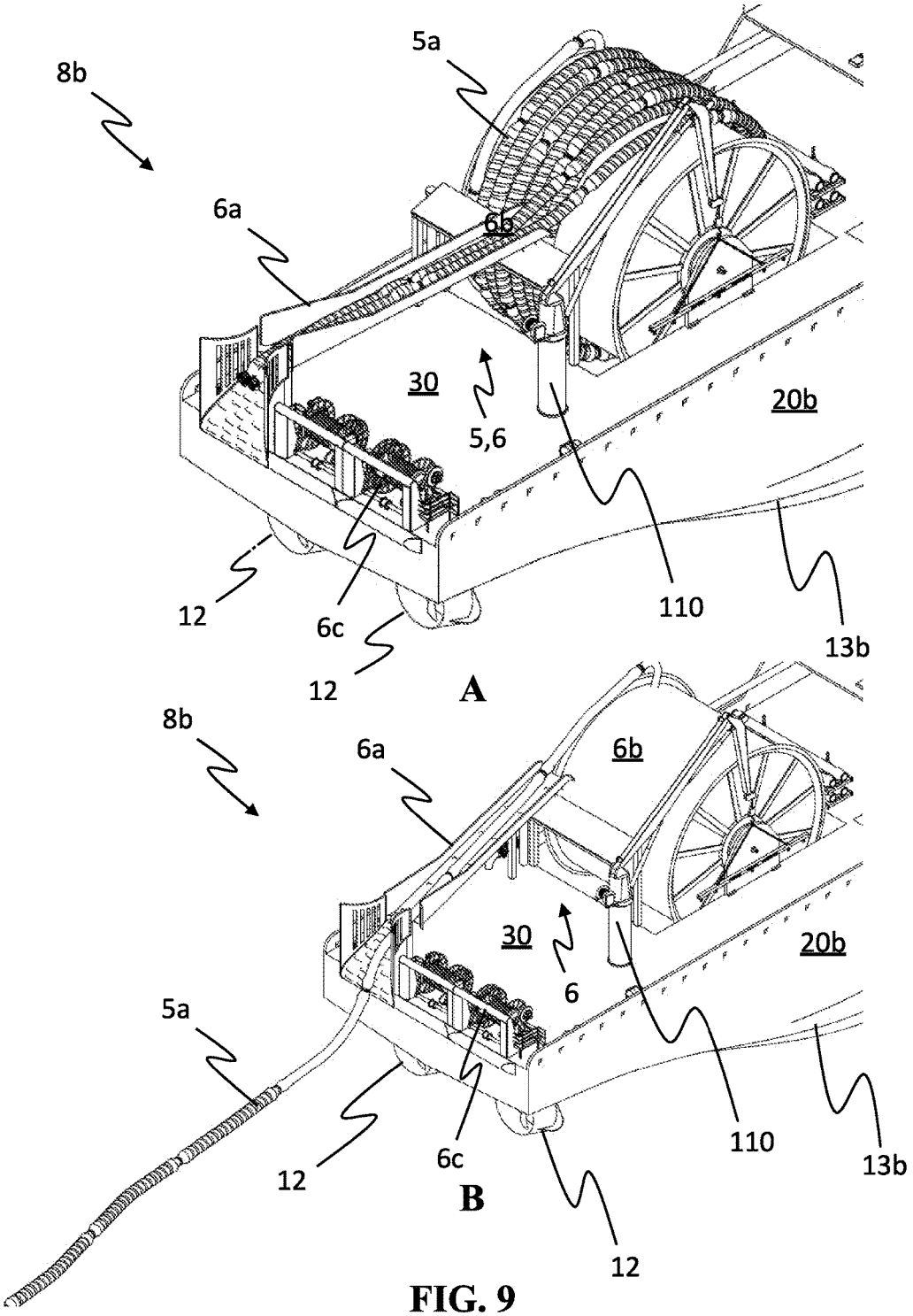
FIG. 9 shows perspective views of the stern part of a cargo transfer vessel with a reel-based offloading system in accordance with the first embodiment of the invention, in which FIG. 9A

The arrangement with the lowered hose drum 6*b* and the spooling device 6*a* for the discharge hose 5*a* also enables an efficient disconnection and replacement of a damaged hose section, preferably by use of a dedicated discharge hose crane 110 (see e.g. FIG. 9).

Figure 11:
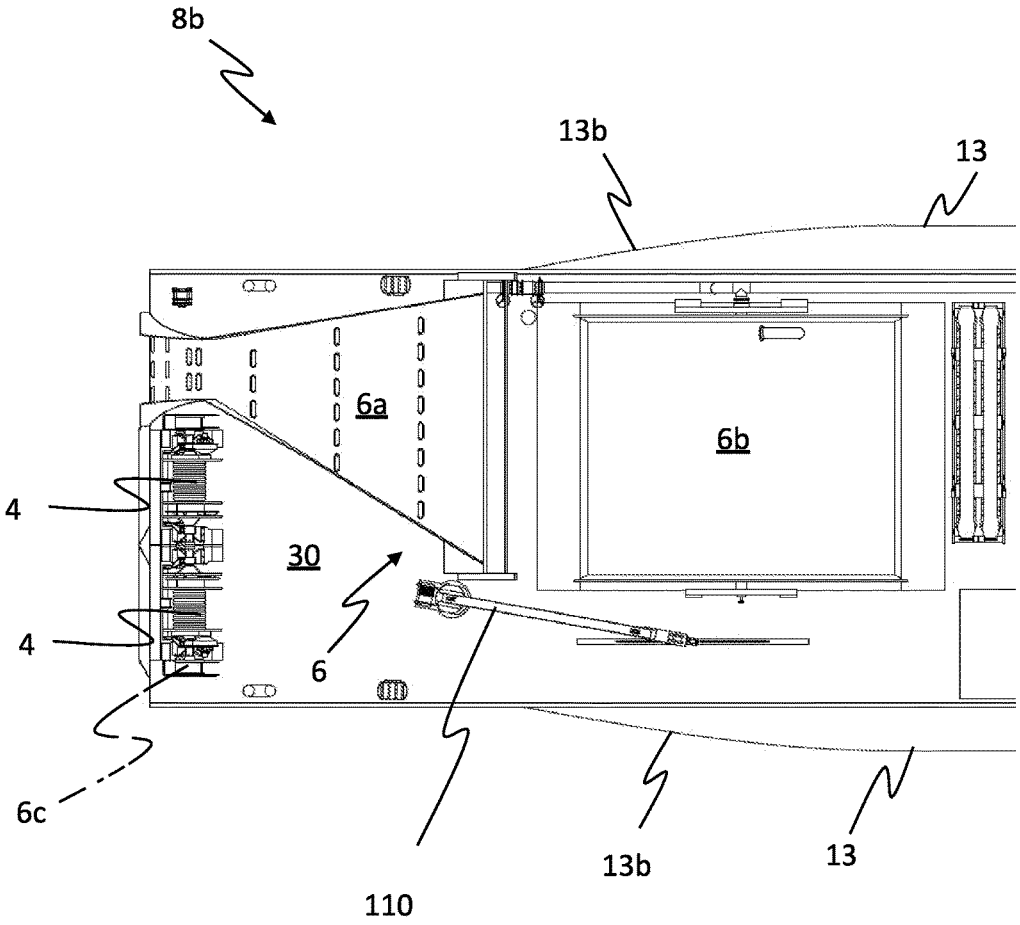
FIG. 11 shows a top view of the stern part of a cargo transfer vessel in accordance with a second embodiment of the invention.
Figure 12:
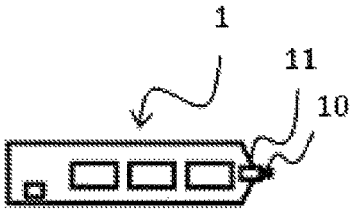
FIGS. 12-16 show principle top view sketches of the intermediate steps in a method for the transfer of hydrocarbon fluid from an offshore production facility and the fluid carrying vessel via a dedicated cargo transfer vessel in accordance with the invention and FIGS. 17 and 18 show principle sketches in top view and side view, respectively, illustrating the inventive transfer system in a fully assembled transfer mode.
Figure 12:
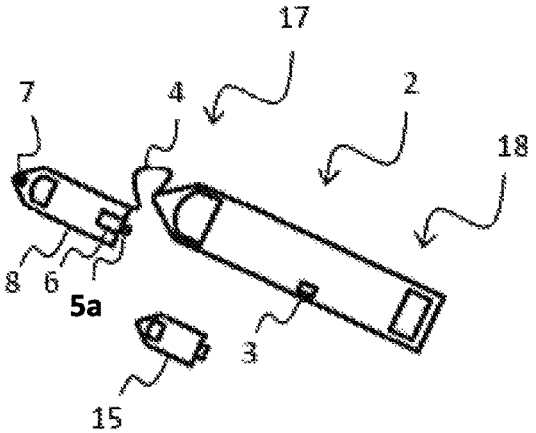
Figure 13:
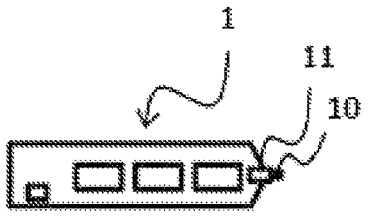
Figure 13:
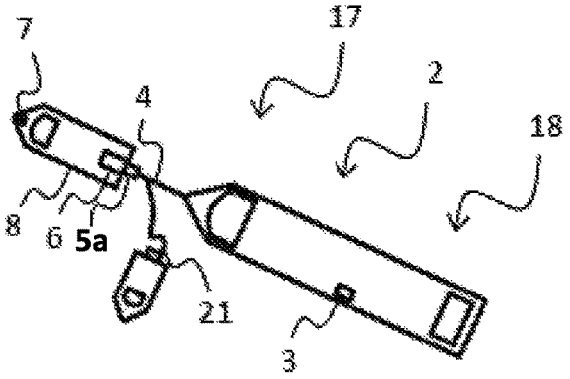
Figure 14:
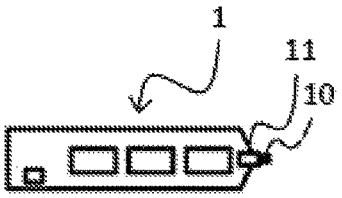
Figure 14:
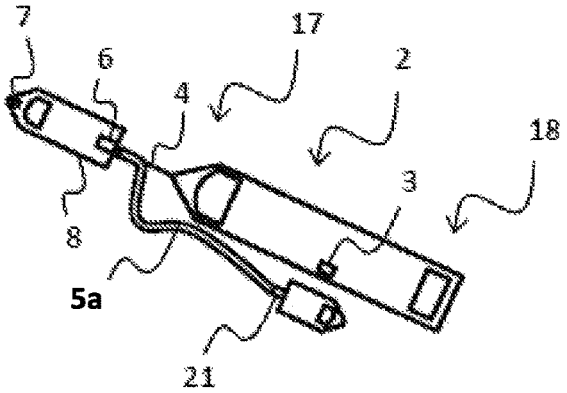
Figure 15:
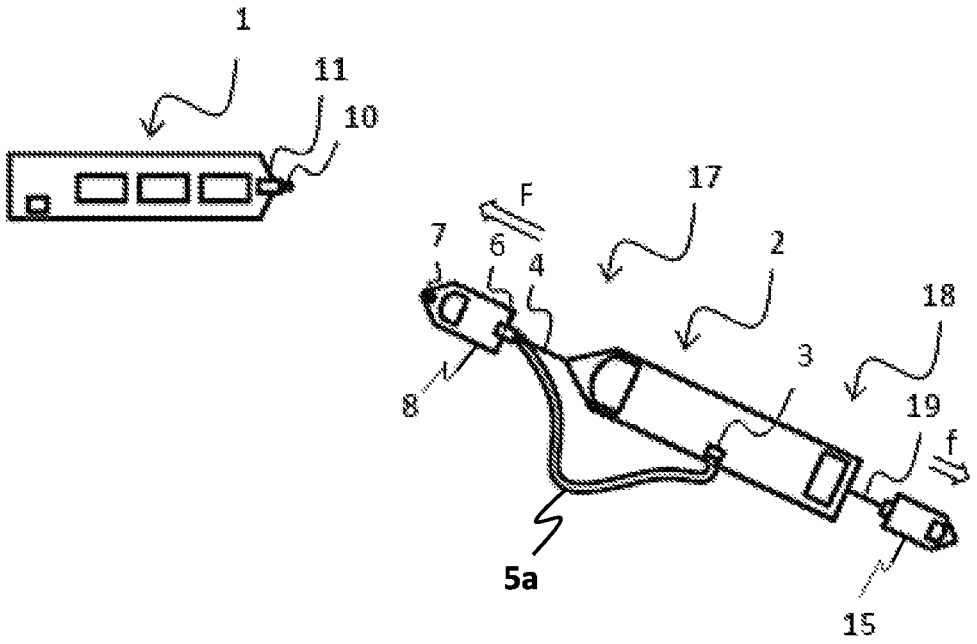
Figure 16:
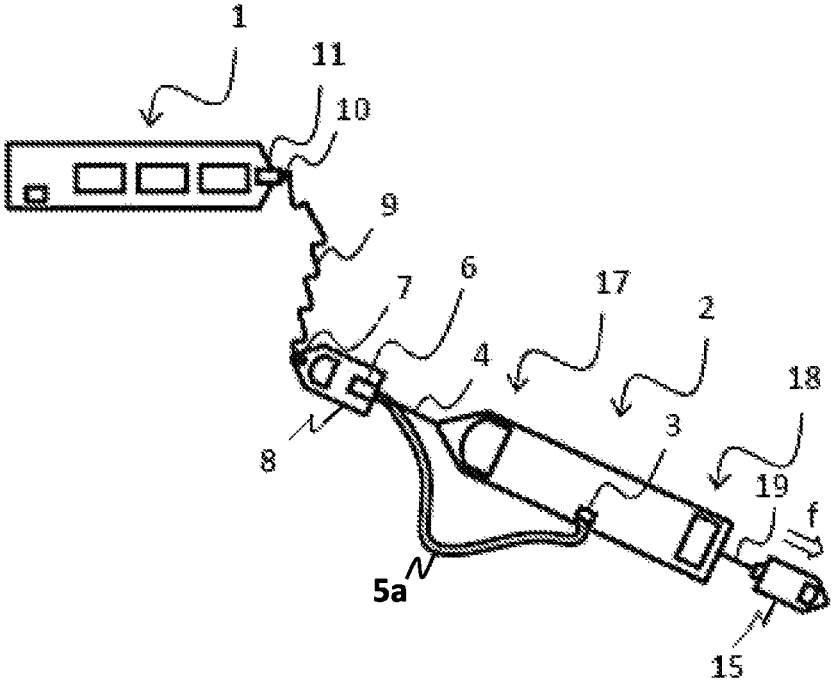
Figure 17:
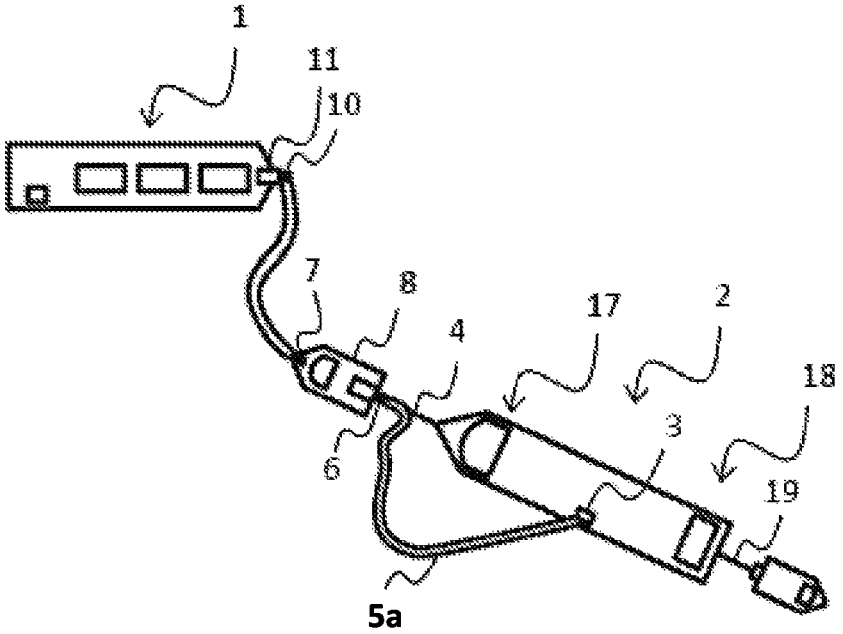
Figure 18:
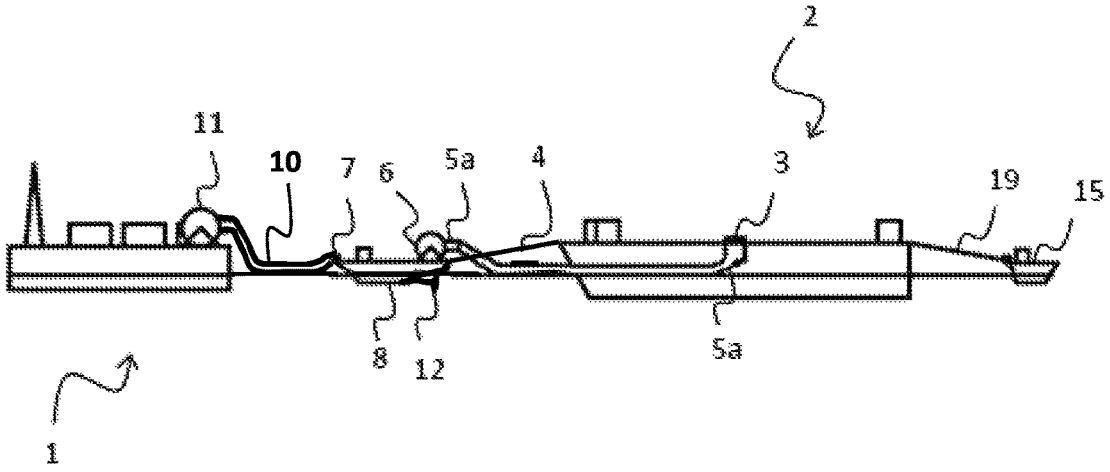

A reel-based offloading system 6 having an alternative spooling device 6*a* is illustrated in FIG. 11. In this embodiment the spooling device 6*a* is fixed relative to the underlying deck 30 and the vessel discharge hose 5*a* slides onto the support surface during reeling/unreeling, covering an axial distance corresponding to the drum's 6*b* axial length.

The operation of the inventive transfer arrangement may be described in the following steps (not necessarily in sequence), with reference to FIGS. 12-18:

1. (FIG. 12) The CTV 8 is transferring one or more tanker hawsers 4 to a mooring connection (e.g. Smith bracket (s)) in the bow part 17 of the tanker 2.
2. (FIG. 13) After the tanker hawser(s) 4 is/are connected, the CTV 8 moves to a "towing" position. At the same time, or afterwards, one or more pick-up and messenger lines connected to vessel discharge hose(s) 5*a* is/are transferred to an assisting tug 15. During the transfer the discharge hose(s) 5*a* is/are at least partly reeled to a discharge hose drum 6*b* on the CTV 8
3. (FIG. 14) The tug 15 pulls the end of the discharge hose 5*a* to a position close to a tanker manifold 3, and transfer the pick-up and messenger line(s) to the tanker 2. The tanker manifold 3 is normally situated midship of the tanker 2.
4. (FIG. 15) After the pick up and messenger line(s) is/are transferred to the tanker 2, the tug 15 moves to the stern 18 of the tanker 2 and connects a tug hawser 19 to the tanker 2. The tug 15 then moves to a position where it may start adding a constant force to the tanker 2. The tug 15 will operate according to instructions given by the operator in charge located in the CTV 8 and/or the tanker 2.
5. (FIG. 15) After the tug 15 is connected stern 18 of the tanker 2, the tanker 2 may shut off the main engine and the CTV 8 starts moving towards the offshore production facility 1. The hook-up of the vessel discharge hose 5*a* to the tanker manifold 3 of the tanker 2 may continue during the move towards the facility 1. Further, the hook-up of the discharge hose 5*a* may be made by use of a standard crane on the tanker 2. The tanker 2 is lifting up the end(s) of the discharge hose(s) 5*a* and connects the discharge hose(s) to the tanker manifold 3.
6. (FIGS. 16 and 17) The CTV 8 and then tanker 2 are moving into a position where the CTV 8 can receive a production facility messenger line 9 from and offloading station on the offshore production facility 1.
7. (FIGS. 17 and 18) Keeping the CTV 8 positioned by a DP system 12,12*a*, the production facility loading hose 10 is pulled over from the offloading station 11 and connected to the loading arrangement 7,107 on the CTV 8.
8. (FIGS. 17 and 18) With all connections made, the offloading and transfer operation may start.
9. When a constant or near constant flow is reached one or more booster pumps may be started to increase the transfer rate. The booster pump(s) is/are preferably equipped with a variable speed motor to allow a good control of the flow rate.
10. After completing the transfer operation the cargo pumps are stopped. The production facility loading hose(s) 10 is/are then flushed with liquid (e.g. water) and/or purged with nitrogen and/or inert gas from the production facility 1 side.

11. When the flushing and/or the purge is completed, the loading hose(s) 10 from the production facility 1 is/are disconnected and the CTV 8 and the tanker 2 moves away from the production facility 1.
12. When reading a "safe" distance from the production facility 1 the disconnection of the vessel discharge hose(s) 5*a* on the tanker 2 can be made.
13. The discharge hose(s) 5*a* is/are then reeled back to the discharge hose drum 6*b* at the CTV 8.
14. The main engine of the tanker 2 is started and the tanker hawser(s) 4 between the tanker 2 and the CTV 8 is/are disconnected from the tanker 2.
15. The tanker 2 starts moving and the tug 15 is disconnected from the tanker stern 18.

The function of the tug 15 may be partly or fully replaced by dynamic position means 12,12*a* on the CTV 8 and/or the tanker 2.

The loading and transfer operation undertaken by use of the CTV 8 has additional safety features, both related to the use of well proven loading arrangement and the introduction of additional safety distances between the offshore production facility 1 and the receiving tanker 2.

The offloading arrangement for transfer of fluid between the offshore production facility 1 and the CTV 8 may be a conventional offshore loading system that has been in operation both in the North Sea and in Brazil for several decades.

The discharge arrangement for discharge of fluid between the CTV 8 and the tanker 2 may preferably be similar to the standard arrangement used for loading to trading tankers from "Calm Buoys". This system has been in operation for a long period e.g. at offshore production units in West Africa.

When combining the offloading arrangement and the discharge arrangement the distance between the offshore production facility 1 and the tanker 2 is significantly increased compared to the standard tanker connection. The increased distance between the two units 1,2 is an important safety feature.

The inventive roll suppressing means in form of protrusions 13 from the vessel's hull 20 further increase the safety and simplicity of the fluid transfer and in addition contribute to set an optimum heading and position of the CTV 8 in order to reduce the tensions and motions in the tanker hawser 4. The transfer system may be used for offloading from "spread" moored offshore floating units and from "turret" moored offshore units. The system may also be considered for offloading from "fixed" unit (unit fixed to the seabed) having an offshore storage facility, e.g. a submerged oil storage tank.

In the preceding description, various aspects of the vessel, the method and the transfer arrangement according to the invention have been described with reference to the illustrative embodiment. For purposes of explanation, specific numbers, systems and configurations were set forth in order to provide a thorough understanding of the invention and its workings. However, this description is not intended to be construed in a limiting sense. Various modifications and variations of the illustrative embodiment, as well as other embodiments of the vessel, method or arrangement, which are apparent to persons skilled in the art to which the disclosed subject matter pertains, are deemed to lie within the scope of the present invention.

REFERENCE LIST

1 Offshore production facility
2 Tanker/fluid carrying vessel
3 Tanker manifold
4 Tanker hawser
5 Discharge arrangement/Stern Discharge System (SDS)
5*a* Vessel discharge hose
6 Reel-based offloading system
6*a* Spooling device/loading hose support structure
6*b* Discharge hose drum
6*c* Mooring hawser arrangement
7 Loading arrangement
7*a* Loading manifold
7*c* Line-handling winch
8 Cargo transfer vessel/CTV
8*a* Bow part of transfer vessel
8*b* Stern part of transfer vessel
9 Production facility messenger line
10 Production facility loading hose
11 Offshore production facility offloading station
12 Propulsion means/main thruster/stern DP system
12*a* Bow dynamic positioning means/Bow DP thruster/Bow DP system
13 Protruding hull member/Roll suppressing protrusion
13*a* First end section of protruding hull member/bow end section
13*b* Second end section of protruding hull member/stern end section
13*c* Resistance reducing arc at the first end section of the protruding hull member
13*d* Resistance reducing arc at the second end section of the protruding hull member
14 Water line
15 Assisting tug
16 Fluid coupling system
17 First end of tanker/tanker bow
18 Second end of tanker/tanker stern
19 Tug hawser/tug towing hawser
20 Cargo transfer vessel hull
20*a* First outer longitudinal hull side
20*b* Second outer longitudinal hull side
20*c* Recess in hull
21 Cargo transfer vessel messenger line
30 Cargo transfer vessel deck
107 Second loading arrangement/side loading arrangement
107*a* Loading manifold
107*b* Service crane
108 Living quarter
109 Cargo pipe
110 Discharge hose crane

The invention claimed is:

1. A transfer vessel for assisting offloading and transfer of fluid from an offshore production facility to a fluid carrying vessel in open sea comprising a transfer vessel hull having a first and a second outer longitudinal hull side;

a transfer vessel deck;

a propulsion arrangement for actively maintaining the transfer vessel at a predetermined safety distance from the offshore production facility and the fluid carrying vessel during fluid transfer operations;

a fluid transfer device for transferring fluid between the offshore structure and the fluid carrying vessel at said predetermined safety distance, said fluid transfer device comprising a side loading arrangement for receiving fluid from the offshore production facility comprising at least one loading manifold positioned at a side of the transfer vessel and configured to be connected to an end of at least one production facility loading hose, a discharge arrangement for discharging fluid to the fluid carrying vessel comprising at least one vessel discharge hose and a fluid coupling system situated in the transfer vessel forming a fluid communicating coupling between the loading arrangement and the discharge arrangement, wherein the hull further comprises a main hull member and at least one protruding hull member having two end sections arranged below the transfer vessels water line at each of the outer longitudinal hull sides, wherein the at least one protruding hull member extends at least partly along the longitudinal length of the main hull member, wherein one or both end sections of the at least one protruding hull member have an inclination angle exceeding 10° relative to a horizontal plane, for suppressing roll of the vessel, yet further wherein an outermost horizontal projection of both of the end sections of the at least one protruding hull member defines a resistance reducing arc reducing the vessel's propulsion resistance, the resistance reducing arc curving towards a vertical center plane of the hull, wherein the length of the resistance reducing arc at the one end section is shorter than the length of the resistance reducing arc at the opposite end section, and wherein the resistance reducing arc with the shorter length is situated closest to the bow of the transfer vessel.

2. The transfer vessel in accordance with claim 1, wherein an extension of the at least one protruding hull member includes the hull's longitudinal midpoint.

3. The transfer vessel in accordance with claim 1 or 2, wherein at least one longitudinal section of the at least one protruding hull member extends beyond the lateral boundaries of the transfer vessel's deck.

4. The transfer vessel in accordance with claim 1, wherein an outermost horizontal projection of one or both end sections of at least one of the at least one protruding hull member defines a resistance reducing arc reducing the vessel's propulsion resistance, the resistance reducing arc curving towards a vertical center plane of the hull.

5. The transfer vessel in accordance with claim 1, wherein at least one of the resistance reducing arcs terminates at a termination point situated at a surface of the main hull member.

6. The transfer vessel in accordance with claim 1, wherein a main part of the transfer vessel's bottom is flat.

7. A method for transferring hydrocarbon containing fluid from an offshore production facility to a fluid carrying vessel for receiving and storing hydrocarbons via an intermediate transfer vessel in accordance with claim 1, wherein the method comprises the following steps:

a. transferring the end of the at least one vessel discharge hose to an assisting tug, b. moving the assisting tug with the end of the vessel discharge hose to a position where the end of the vessel discharge hose may be connected to the tanker manifold, c. connecting the end of the vessel discharge hose to the tanker manifold allowing the fluid to flow from the transfer vessel to a fluid tank within the fluid carrying vessel, d. moving the transfer vessel to a position where at least one production facility loading hose may be transferred between the offshore production facility and the transfer vessel, e. connecting the at least one production facility loading hose to the loading arrangement and f. transferring desired amount of fluid between the offshore production facility and the fluid carrying vessel via the at least one production facility loading hose, the loading arrangement, the fluid coupling system and the discharge arrangement.

8. The method in accordance with claim 7, wherein the method comprises the additional step of connecting at least one tanker hawser between the transfer vessel and a first end of the fluid carrying vessel prior to step a.

9. The method in accordance with claim 8, further comprising the additional step of picking up and pulling at least one messenger line connected to the end of the at least one vessel discharge hose.

10. The method in accordance with claim 9, wherein the method comprises the additional step of moving an assisting tug to a second end of the fluid carrying vessel, connecting a tug towing hawser between the assisting tug and the second end of the fluid carrying vessel and adding a pulling force on the second end of the fluid carrying vessel by means of the assisting tug, the pulling force being directed away from the offshore production facility.

11. The method in accordance with claim 10, wherein the method comprises the additional step of connecting at least one production facility messenger line between the offshore production facility and the transfer vessel.

12. The method in accordance with claim 11, wherein the method comprises the additional step of controlling the position of the transfer vessel by means of dynamic positioning arrangement.

13. The method in accordance with claim 12, wherein the method comprises the additional step of controlling the flow rate between the offshore production facility and the fluid carrying vessel by means of at least one booster pump.

14. A transfer arrangement comprising an offshore production facility for producing hydrocarbons, at least one production facility loading hose situated on the offshore production facility, a fluid carrying vessel for receiving and storing hydrocarbons and a transfer vessel in accordance with claim 1, wherein the transfer arrangement further comprises an assisting tug for transferring an end of at least one vessel discharge hose from the transfer vessel to the tanker manifold on a fluid carrying vessel.

* * * * *